United States Patent [19]

Gorris et al.

[11] Patent Number: 4,549,335

[45] Date of Patent: Oct. 29, 1985

[54] METHOD OF MANUFACTURING MULTICONDUCTOR CABLES

[75] Inventors: Joannes J. H. M. Gorris, Eindhoven; Wilhelmus L. L. Lenders, Son, both of Netherlands

[73] Assignee: U.S. Philips Corporation, New York, N.Y.

[21] Appl. No.: 505,537

[22] Filed: Jun. 17, 1983

[30] Foreign Application Priority Data

Jul. 7, 1982 [NL] Netherlands ..... 8202728

[51] Int. Cl.[4] ..... H01R 43/04

[52] U.S. Cl. ..... 29/866; 29/857; 140/92.1

[58] Field of Search ..... 29/745, 753, 759, 857, 29/866; 140/92.1, 147

[56] References Cited

U.S. PATENT DOCUMENTS 3,938,748 2/1976 Camardella ..... 140/92.1 X 4,173,312 11/1979 Camardella ..... 140/92.1 X 4,428,114 1/1984 Teagno ..... 29/857

FOREIGN PATENT DOCUMENTS 2854770 7/1980 Fed. Rep. of Germany .

*Primary Examiner*—Howard N. Goldberg
*Assistant Examiner*—Carl J. Arbes
*Attorney, Agent, or Firm*—David R. Treacy

[57] ABSTRACT

A method and a device are provided for manufacturing a cable comprising a number of insulated wires extending between two connector blocks to which each wire is connected at its ends. A wire is wound several times around two spaced points of supports which are adjustable to vary the distance between them, the resulting turns of wire being disposed at equal distances from one another on the points of support. Subsequently, at one of the points of support, the wire turns are each connected to respective connectors of each of two connector blocks after which the turns are severed between the two connector blocks.

4 Claims, 5 Drawing Figures

METHOD OF MANUFACTURING MULTICONDUCTOR CABLES

BACKGROUND OF THE INVENTION

The invention relates to a method of manufacturing a wire cable comprising a number of insulated wires extending between two connector blocks to which each wire is connected at its ends.

For the manufacture of such multiconductor cables, machines are known in practice which draw a number of wires, corresponding to the desired number of wires in the cable to be manufactured, simultaneously over a given desired length from a supply reel, and then connect all the wires to a common connector block at each end. These known machines have the disadvantage that they are technically complicated and comparatively expensive. Furthermore, these machines are not very flexible because readjustment to produce cables of different lengths or with different numbers of wires is difficult and timeconsuming. As a result, with these machines production is possible only in batches, and therefore a considerable inventory of unfinished goods is unavoidable.

SUMMARY OF THE INVENTION

An object of the invention is to provide a method by which multiconductor cables can be manufactured in a simple and flexible manner so that cables of different lengths and with different numbers of wires can be very readily manufactured in a continuous succession. A further object is to provide a method which can be carried out by means of a comparatively simple and compact device.

The method according to the invention is characterized in that a wire is wound several times around two spaced points of support which are adjustable to vary the distance between them, the resulting turns of wire being disposed at equal distances from one another on the points of support. After this, at one of the points of support, the wire turns are connected to the connectors of two connector blocks, each of which blocks comprise a number of connectors corresponding to the number of wire turns; and the turns are then severed between the two connector blocks.

In the method according to the invention, only one wire is used, and the number of wires in the cable is determined by the number of turns of wire wound round the supports. Therefore, a change in the number of wires per cable can be obtained in a very simple manner.

The wire turns can be connected to the connectors of the connector blocks after the turns have been wound. An advantageous way of doing this consists, according to a preferred embodiment of the invention, in that before the winding operation the two connector blocks are secured at one of the points of support so that during winding the wire is wound over the blocks, the wire turns being connected to the connectors after the winding operation. Connectors can be used to which the turns of wire can be connected by pressing the turns into the metal connectors, the connectors cutting through the insulation on the wires.

Other connector constructions with other methods of connection can also be used.

In order to ensure that the turns of wire are correctly positioned on the connector blocks, the two connector blocks are offset from one another by the pitch distance between the connectors so that the first and last turns of wire are each wound over only one connector block.

The invention also relates to a device for manufacturing a multiconductor cable by means of the method described above.

According to the invention, the device is characterized in that it comprises a winding arm which is connected to a rotatable hollow shaft coupled to a drive, and that a part of the device positioned opposite the winding arm comprises two supports which provide the above-mentioned points of support and which are adjustable to vary the distance between them. Further, means are provided whereby a wire unreeling from the winding arm is laid in the desired positions on one of these supports.

According to one embodiment of the device, the device part comprises a guide rod which forms part of a rotary cage comprising two end flanges between which a number of guide rods is arranged, the cage being rotatable to bring the guide rods one-by-one into a position opposite the winding arm.

In another embodiment, the guide rods are arranged with supports between two chains which can be driven.

In a further embodiment, at each of the guide rods a first support is fixedly arranged, while a second support is displaceable along the rod.

Each of the first supports can be constructed so that two connector blocks can be so arranged thereon as to be offset from one another by the pitch distance between the connectors of the block.

The invention will be described more fully with reference to the drawings, which show diagrammatically embodiments of the device according to the invention for manufacturing multiconductor cables.

DESCRIPTION OF THE PREFERRED EMBODIMENTS

Figure 1:
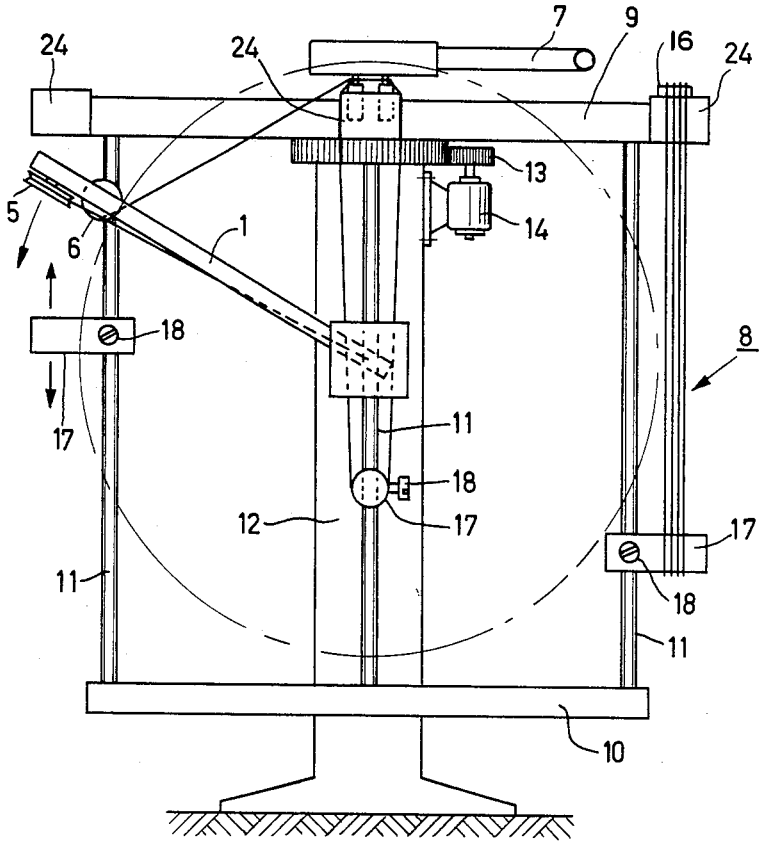
FIGS. 1 and 2 show diagrammatically in side elevation and in plan view, respectively, a device for winding a series of cables.
Figure 2:
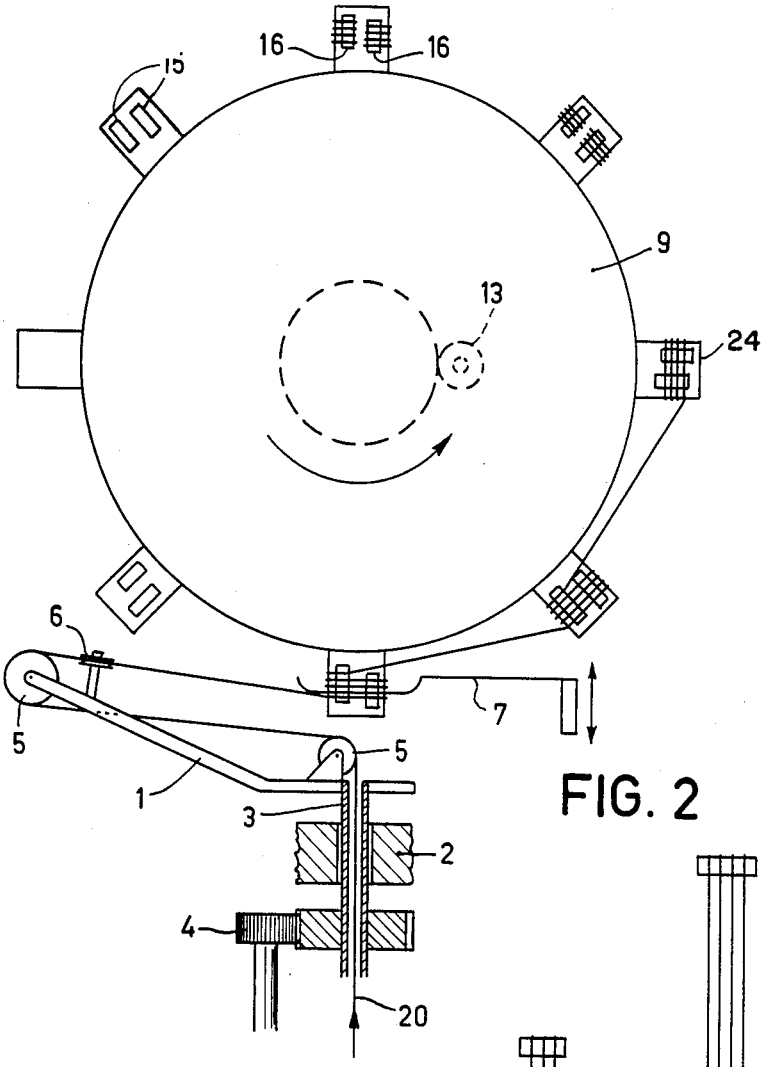

In FIGS. 1 and 2, reference numeral 1 denotes a winding arm. This winding arm 1 is connected to a hollow shaft 3 rotatable in a frame 2. The shaft 3 is coupled through a transmission 4 to a drive not shown, for example, an electric motor.

The winding arm 1 is provided with a pair of wire-guiding wheels 5 and an unreeling wheel 6.

Opposite the winding arm 1 there is arranged a cage 8, which mainly consists of two flanges 9 and 10 connected to each other by a number of guide rods 11. The flanges 9 and 10 are rotatable around a column 12, the flange 9 being coupled through a gearwheel transmission 13 to an electric motor 14.

Figure 4:
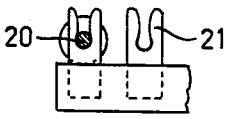
FIG. 4 shows a part of a connector block.
Figure 3:
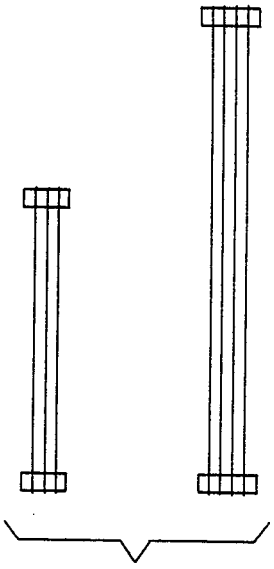
FIG. 3 shows by way of example two multiconductor cables with different numbers and lengths of wires.

At each of the areas at which the rods 11 are connected to the flange 9, a first fixed support 24 is connected to this flange adjacent the respective rod. Each of the supports 24 is provided with two recesses 15, each of which can receive a connector block 16 having a row of U-shaped metal connectors 21 (see FIG. 4).

The two recesses in each support are slightly offset from one another in the radial direction of the cage so that when connector blocks are mounted in the two recesses, these blocks are similarly offset from one another by the pitch distance between the connectors of the blocks.

The rods 11 each carry a second support 17 which is adjustable along the rod.

The rods 11 and the supports 17 can be constructed in a number of ways. In the embodiment shown the supports 17 are slidably adjustable along the rods 11 and are secured on the rods by means of clamping screws 18. It is also possible to construct each of the rods 11 as a lead screw cooperating with a female thread in each of the supports 17 so that the supports are adjustable by rotation of the rods.

Thus, the supports 17 can be moved along the rods 11 to adjust their distances from the supports 24.

Above the fixed support 24 which is positioned opposite the winding arm there is disposed a wire-guiding plate 7, which can be moved to and fro by a control member which is represented only schematically.

The operation of this device is as follows. A wire 20 is supplied from a supply reel not shown to the hollow shaft 3 and is then guided round the guide wheels 5 and the unreeling wheel 6. Subsequently, the wire 20 runs over the wire-guiding plate to one of the supports 24, in which connector blocks have already been arranged and which is then positioned opposite the winding arm.

The winding arm 1 is then rotated through a number of revolutions equal to the number of connectors 21 on each of the connector blocks 16, the wire-guiding plate 7 being shifted after each revolution of the winding arm through a distance corresponding to the pitch distance between the connectors 21. In this manner, a number of turns of wire corresponding to the desired number of wires in each of the wire strands to be manufactured is wound round the support 24 which is opposite the winding arm and round the associated support 17, the turns passing over the connector blocks on the support 24.

When the desired number of wire turns has been wound, the cage is rotated in the direction of the arrow until the next rod 11 with supports 24 and 7 is located opposite the winding arm. The wire is then wound round these supports and the wire turns on the proceding supports are connected to the connectors of the respective pair of connector blocks 16. This can be effected in different ways, for example, by the use of connector blocks of the construction illustrated in FIG. 4. In these blocks the wire turns are pressed into the recesses in the metal connectors 21, the metal cutting through the insulation on the wire.

In a next position of the cage the turns of wire are severed between the two connector blocks and the finished multiconductor cable can be taken from the machine.

As already mentioned, the connector blocks 16 are so arranged on each support 24 as to be offset from one another by the pitch distance between the connectors of the blocks, which means that the first and last turns of wire on the support each engage a connector of only one connector block. Consequently, when the wire turns have been severed between the blocks, the adjacent cables are no longer connected to each other.

After the finished cable has been removed, the succeeding positions of the cage can be utilised for the mounting of the connector blocks in the recesses 15 in the supports 24 and, if required, for the adjustment of the distances of the supports 17 from the supports 24. In this way the length of the cables to be manufactured can be varied very readily.

Also the number of wires in each cable can be readily varied by appropriate control at the drive of the winding arm.

Figure 5:
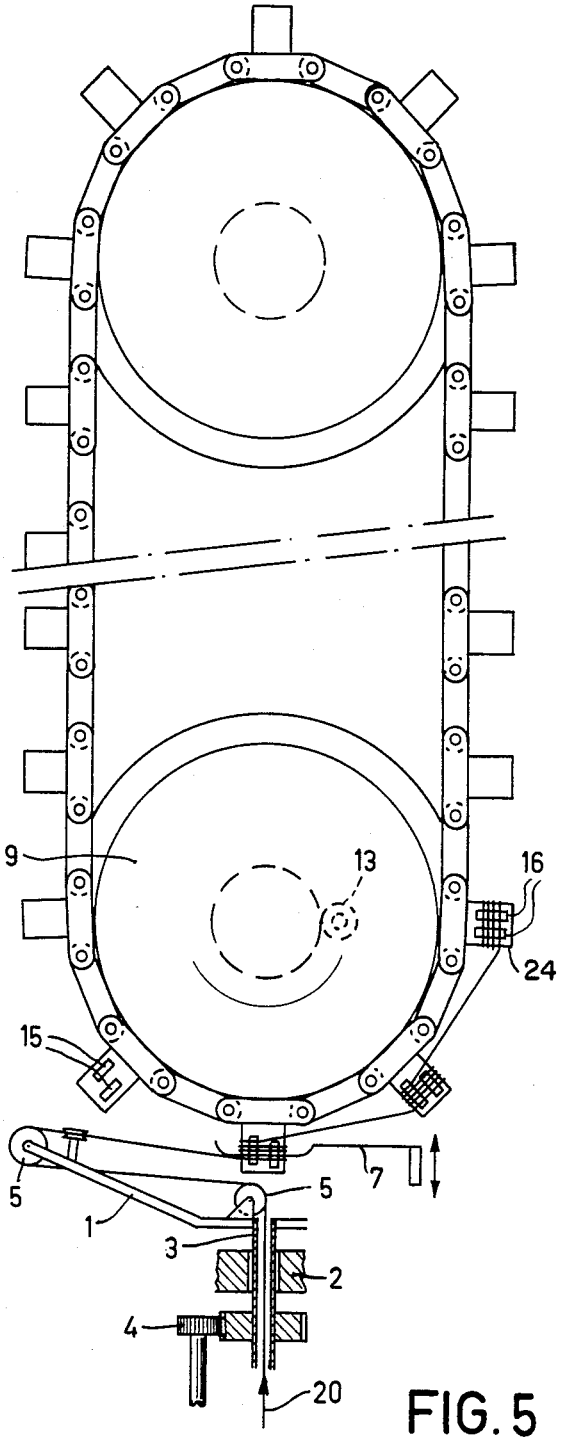
FIG. 5 shows in plan view a device similar to that shown in FIGS. 1 and 2 but in which the cage comprising the guide rods is replaced by a chain system carrying guide rods.

FIG. 5 shows the cage 8 replaced by two endless chains 25 which carry the guide rods 11 and the supports and which are guided round chain wheels, which can be driven in the same manner as the flanges 9 and 10 of the cage 8.

What is claimed is:

1. A method of manufacturing a cable comprising a number of insulated wires extending between two connector blocks to which each wire is connected at its ends, characterized by providing two spaced points of support, said points being adjustable to vary the distance between them, providing two connector blocks on one of said points of support, each comprising a number of connectors corresponding to said number of wire turns, winding a wire several times around said two spaced points of support, such that the resulting turns of wire are disposed at equal distances from one another on the points of support, then, at said one of the points of support, connecting each of the wire turns to the respective connectors of said two connector blocks, and then severing the turns at said one of the points of support between the two connector blocks.

2. A method as claimed in claim 1, characterized by securing the two connector blocks at said one of the two points of support before the winding operation so that during winding the wire is wound over the blocks, the wire turns being connected to the connectors after the winding operation.

3. A method as claimed in claim 2 characterized by arranging the two connector blocks beside each other at said one of the points of support in positions such that the blocks are offset from one another by the pitch distance between the connectors, so that the first and last turns of wire are each wound over only one connector block.

4. A method as claimed in claim 1, characterized by arranging the two connector blocks beside each other at said one of the points of support in positions such that the blocks are offset from one another by the pitch distance between the connectors, so that the first and last turns of wire are each wound over only one connector block.

* * * * *